US010907299B1

(12) United States Patent
Savage et al.

(10) Patent No.: US 10,907,299 B1
(45) Date of Patent: Feb. 2, 2021

(54) HEATER AND CONTROL SCHEME FOR MULTI-COMPARTMENT DRYER

(71) Applicant: WHIRLPOOL CORPORATION, Benton Harbor, MI (US)

(72) Inventors: Jason R. Savage, St. Joseph, MI (US); James P. Carow, Coloma, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/597,339

(22) Filed: Oct. 9, 2019

(51) Int. Cl.
*D06F 58/30* (2020.01)
*D06F 105/28* (2020.01)

(52) U.S. Cl.
CPC ..... *D06F 58/30* (2020.02); *D06F 2105/28* (2020.02)

(58) Field of Classification Search
CPC .... D06F 58/30; D06F 2105/28; F24C 15/106; G05D 23/1909; H01H 57/00
USPC ..... 34/540; 219/486
See application file for complete search history.

(56) References Cited

U.S. PATENT DOCUMENTS 3,824,813 A 7/1974 Davis
5,235,159 A 8/1993 Kornrumpf et al.
5,524,362 A * 6/1996 Quandt ..... D06F 34/28 34/526
5,619,614 A * 4/1997 Payne ..... G05B 19/042 706/1
5,647,231 A * 7/1997 Payne ..... G06N 7/04 68/12.01
6,079,121 A * 6/2000 Khadkikar ..... D06F 58/30 34/528
6,157,008 A 12/2000 Brown et al.
7,420,140 B2 9/2008 Lenhart, Jr. et al.
7,574,269 B2 8/2009 Cenedese et al.
7,750,499 B2 7/2010 Jeong
7,904,983 B2 3/2011 Jun et al.
8,051,685 B2 11/2011 Kim
8,367,979 B2 2/2013 Oyler et al.
10,333,731 B2 * 6/2019 Ebrom ..... G06F 8/34
10,704,189 B2 * 7/2020 Christensen ..... D06F 25/00
2009/0165328 A1 7/2009 Grunert et al.
2010/0192404 A1 * 8/2010 Maltese ..... D06F 58/30 34/524
2012/0096737 A1 * 4/2012 Kmet ..... D06F 34/18 34/443
2014/0268648 A1 * 9/2014 Gomes ..... F21V 33/0044 362/94
2016/0218884 A1 * 7/2016 Ebrom ..... H05B 1/0252

FOREIGN PATENT DOCUMENTS

CA 2651704 A1 * 7/2010 ..... D06F 58/30
EP 2075369 A3 * 1/2012 ..... D06F 58/30

* cited by examiner

*Primary Examiner* — Stephen M Gravini
(74) *Attorney, Agent, or Firm* — Price Heneveld LLP

(57) ABSTRACT

A heater arrangement for a multi-compartment appliance comprises a first heater, a second heater, and a relay. The first heater is disposed within a first airflow path for a first dryer compartment. The second heater is disposed within a second airflow path for a second dryer compartment. The relay interconnects, via an electrical harness, the first and second heaters. The relay, responsive to a demand for heat to the first dryer compartment and the first heater having a temperature being less than a target temperature, diverts power to the first heater.

20 Claims, 4 Drawing Sheets

HEATER AND CONTROL SCHEME FOR MULTI-COMPARTMENT DRYER

TECHNICAL FIELD OF THE DISCLOSURE

The present disclosure generally relates to a multi-compartment dryer and a heater control system and, more specifically, to an appliance control system that diverts power from a first heater to a second heater to increase throughput of the multi-compartment dryer.

SUMMARY OF THE DISCLOSURE

According to one aspect of the present disclosure, a heater arrangement for a multi-compartment dryer comprises a first heater, a second heater, and a relay. The first heater is disposed within a first airflow path for a first dryer compartment. The second heater is disposed within a second airflow path for a second dryer compartment. The relay interconnects the first and second heaters. The relay, responsive to a demand for heat to the first dryer compartment and the first dryer compartment having a temperature being less than a target temperature, diverts power to the first heater.

According to another aspect of the present disclosure, a multi-compartment dryer comprises a first dryer compartment, a second dryer compartment, and an appliance controller. The first dryer compartment includes a first heater and a first rotating drum disposed within the first dryer compartment. The second dryer compartment includes a second heater and a second rotating drum disposed within the second dryer compartment. The appliance controller activates a relay to divert power to the first heater based on a demand to heat the first heater and the first rotating drum being less than a target temperature.

According to yet another aspect of the present disclosure, a laundry appliance system comprises an appliance controller. The appliance controller activates a relay that is responsive to a first heater in a first dryer compartment having a temperature less than a target temperature and a demand for the first dryer compartment being greater than a demand threshold, diverts power to the first heater. The appliance controller is responsive to the first heater reaching the target temperature and the demand being less than the demand threshold, diverts power to a second heater in a second dryer compartment.

These and other features, advantages, and objects of the present disclosure will be further understood and appreciated by those skilled in the art by reference to the following specification, claims, and appended drawings.

Figure 1:
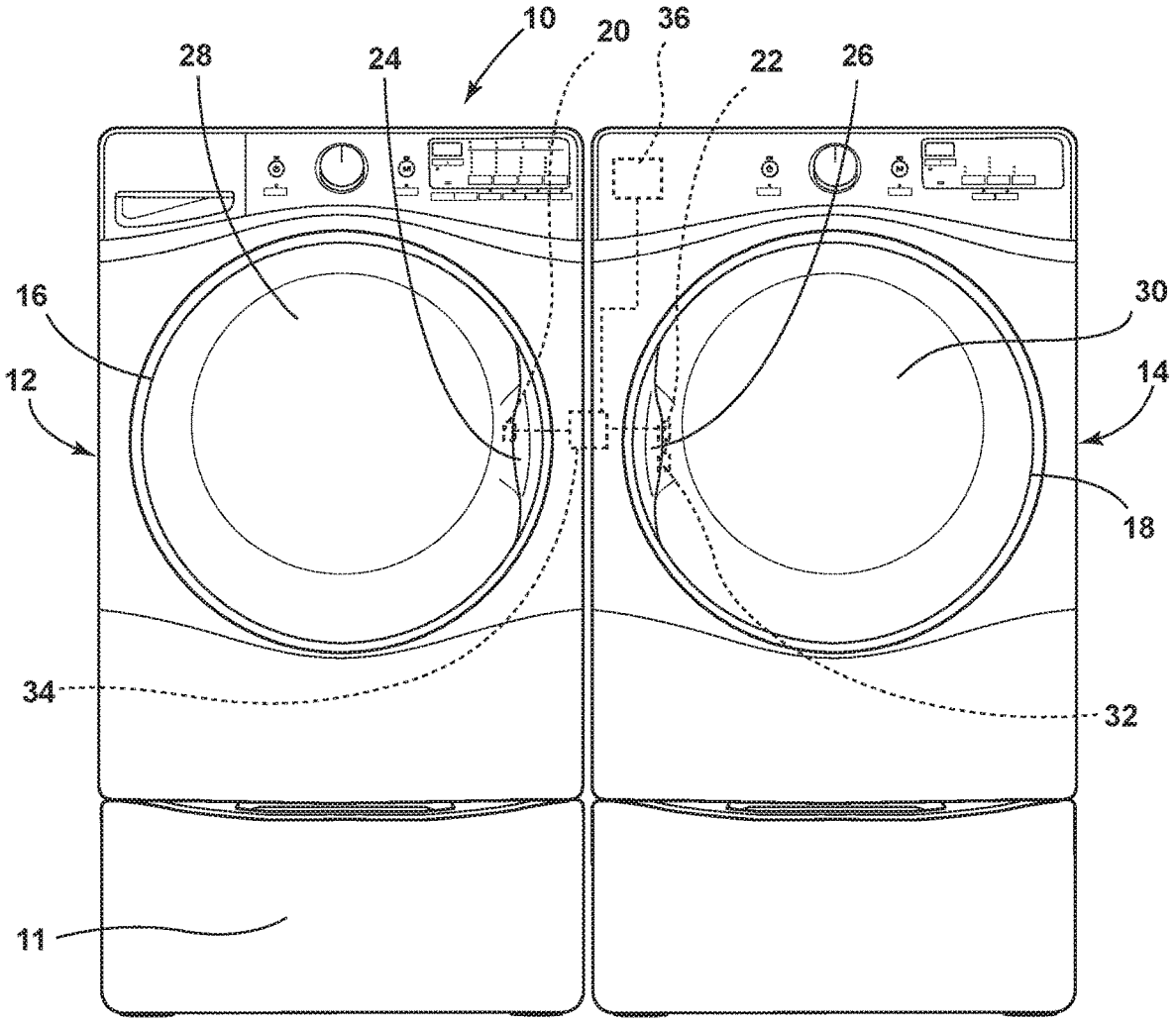
FIG. 1 is a front view of a multi-compartment dryer with first and second dryer compartments.

The components in the figures are not necessarily to scale, emphasis instead being placed upon illustrating the principles described herein.

DETAILED DESCRIPTION

The present illustrated embodiments reside primarily in combinations of method steps and apparatus components related to a multi-compartment dryer. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIG. 1, reference numeral 10 generally designates a multi-compartment dryer. The multi-compartment dryer 10 includes first and second dryer compartments 12, 14. As shown, the first and second dryer compartments 12, 14 may be an upper and lower compartment of the multi-compartment dryer 10 or may be adjacent dryer compartments. Further, the first and second dryer compartments 12, 14 may be used in conjunction with additional dryer compartments 11. Likewise, the first and second dryer compartments 12, 14 may also be used in conjunction with a multi-compartment washer (not shown), or a washer and dryer combination unit (not shown). Each of the first and second dryer compartments 12, 14 also include first and second rotating drums 16, 18. The first and second dryer compartments 12, 14 use first and second heaters 20, 22 disposed within first and second airflow paths 24, 26. The first and second heaters 20, 22 are disposed within the first and second airflow paths 24, 26 to provide heat to the first and second dryer compartments 12, 14. The first and second heaters 20, 22 heat air directed into the first and second dryer compartments 12, 14, respectively, while the first and second rotating drums 16, 18 turn interior sections 28, 30 of the first and second dryer compartments 12, 14 to remove moisture from articles (not shown) within each of the first and second dryer compartments 12, 14. Use of both the first and second dryer compartments 12, 14 provides high throughput for drying operations.

To achieve greater throughput, the multi-compartment dryer 10 may require that the first and second dryer compartments 12, 14 operate simultaneously. However, current electrical limitations, such as a home outlet (not shown) not exceeding 30 amperes (A), provide limitations to operating both the first and second dryer compartments 12, 14. Therefore, operation of the first and second dryer compartments 12, 14 requires a total energy usage for the multi-compartment dryer 10 to be less than 30 A. For example, the first dryer compartment 12 may use the first heater 20, in which the first heater 20 uses 2200 watts (W) of power to dry the first dryer compartment 12. Additionally, the second dryer compartment 14 may use a third heater 32 being powered at 3400 W to dry the second dryer compartment 14. The second heater 22, disposed within the second airflow path 26, may be coupled to the first heater 20 such that the second heater 22 is activated to heat the second airflow path 26 of the second dryer compartment 14 during certain operating conditions of the first heater 20.

As will be described in more detail below, a relay 34 may be used to interconnect the first and second heaters 20, 22. For example, a controller 36 may activate the relay 34 to divert power from the first heater 20 if the first heater 20 has caused the first dryer compartment 12 to reach a target temperature, and no demand exists for heating the first dryer compartment 12. Additionally, the relay 34 may be a passive relay such that in response to the first heater 20 reaching a first heating capacity of the first heater 20, the relay 34 diverts power to the second heater 22. The first heating capacity of the first heater 20 may be indicative of a maximum heating capacity of the first heater 20. For example, the maximum heating capacity may represent the first dryer compartment 12 reaching an upper temperature limit using the first heater 20. This allows the relay 34 to automatically divert power to activate the second heater 22. In at least one other instance, the target temperature may be indicative of the heating capacity of the first heater 20, or be a preset value stored in the controller 36. Therefore, the relay 34 may aid to increase throughput during use of the multi-compartment dryer 10.

Figure 2:
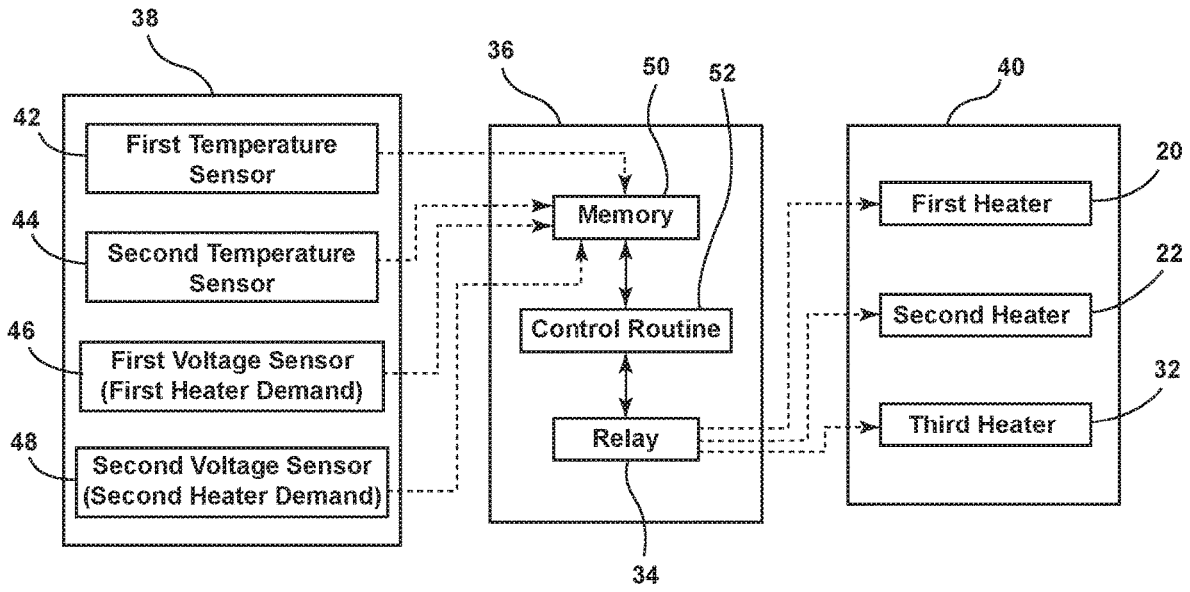
FIG. 2 is a block diagram depicting an appliance control system for the multi-compartment dryer.

FIG. 2 depicts a system block diagram for the controller 36 to activate the relay 34 to provide power to both the first and second heaters 20, 22. In the block diagram depicted in FIG. 2, a plurality of sensors 38 transmit information about the multi-compartment dryer 10 to the controller 36, which activates a plurality of components 40. Specifically, first and second temperature sensors 42, 44 and first and second voltage sensors 46, 48 measure temperatures within the first and second dryer compartments 12, 14, as well as a power demand to either of the first or second heaters 20, 22. The first and second temperature sensors 42, 44 may be resistive temperature sensors, thermistors, thermocouples, or any other temperature sensors that measure a temperature of the first and second dryer compartments 12, 14. The first and second voltage sensors 46, 48 may be capacitive, resistive, or any other sensor that measures or derives a voltage. The controller 36 may include a memory 50 as well as a control routine 52 used to activate the relay 34. Activation of the relay 34 diverts power between the first, second, and third heaters 20, 22, 32.

The first and second temperature sensors 42, 44 transmit temperature information regarding a temperature of the first and second dryer compartments 12, 14 such that the controller 36 compares the temperature information to the target temperature for the first dryer compartment 12 stored within the memory 50 of the controller 36. The controller 36 analyzes the temperature information from the first and second temperature sensors 42, 44 against the target temperature stored in the memory 50, and outputs the control routine 52 such that the relay 34 sends power to either the first or second heaters 20, 22 based on the comparison between the target temperature and the temperature information from the first and second temperature sensors 42, 44 as generally indicated by the arrows in FIG. 2.

Likewise, the control routine 52 may be configured to allow the relay 34 to send power to the third heater 32 independent from the temperature information from the first and second temperature sensors 42, 44. Therefore, as will be described in more detail below, the control routine 52 is configured to activate the relay 34 to power the first and the third heaters 20, 32 in response to a demand from the first and second dryer compartments 12, 14, and the second heater 22 based on the comparison between the target temperature and the temperature information from the first and second temperature sensors 42, 44, as well as the demand from the first dryer compartment 12 from the first and second voltage sensors 46, 48.

The first and second voltage sensors 46, 48 provide data indicative of the demand from the first and second dryer compartments 12, 14. For example, the first voltage sensor 46 may detect an increase of voltage to the first dryer compartment 12 being indicative of a demand for power to the first dryer compartment 12. Likewise, the second voltage sensor 48 may detect an increase of voltage to the second dryer compartment 14 being indicative of the demand for power to the second dryer compartment 14. An increase of voltage to the first or second dryer compartments 12, 14 indicates a heating demand because an increase in voltage indicates a demand for power to the first and second heaters 20, 22, which increases the temperature of the first and second heaters 20, 22. Therefore, an increase in voltage to the first and second heaters 20, 22 is indicative of a demand for heat, via the first and second heaters 20, 22, to the first and second dryer compartments 12, 14.

The first and second voltage sensors 46, 48 provide demand data to the controller 36. Specifically, the first and second voltage sensors 46, 48 provide demand data, as described above, to the control routine 52 used by the controller 36 to activate the relay 34 to divert power to the first or second heaters 20, 22. The relay control routine 52 is such that upon a demand to the first heater 20, via the first voltage sensor 46, the controller 36 activates the relay 34 to divert power to the first heater 20. If the relay control routine 52 receives a demand to the second heater 22, via the second voltage sensor 48, the controller 36 activates the relay 34 to divert power to the second heater 22, being responsive to the first voltage sensor 46 indicating that voltage to the first heater 20 is negligible.

If the controller 36 receives a demand for power from each of the first and second voltage sensors 46, 48, the controller 36 activates the relay 34 to divert power to the first heater 20 to heat the first dryer compartment 12. The control routine 52 prioritizes heating to the first dryer compartment 12. Stated differently, the controller 36 activates the relay 34 to power the second heater 22 when no demand for power to the first heater 20 is present. Again, the controller 36 activates the relay 34 to supply power to the third heater 32 in response to a demand from the second dryer compartment 14. Therefore, the second heater 22 may be used in conjunction with the third heater 32 in response to voltage to the first heater 20 being negligible. The second heater 22 may be used with the third heater 32 in the second dryer compartment 14, which shortens a dry time for the second dryer compartment 14. Shortening the dry time for the second dryer compartment 14 using the second heater 22 increases throughput of the multi-compartment dryer 10.

If no demand to the first heater 20 exists, determined by the first voltage sensor 46, the controller 36 may activate the relay 34 such that a predetermined power is diverted to the second heater 22 to heat the second dryer compartment 14. The predetermined power may be stored in the memory 50 of the controller 36. The predetermined power supplied to the second heater 22 may be sufficient to power the second heater 22 to a maximum heating capacity of the second heater 22. Additionally, the predetermined power may be set based on an outlet capacity. As stated above, operation of the multi-compartment dryer 10 may not exceed 30 A, which is indicative of the outlet capacity. The outlet capacity may be a current limit set by an outlet that does not trip a circuit breaker (not shown). In at least one other instance, the outlet capacity may vary based on home and professional outlet capacities of respective buildings. Therefore, the predetermined power directed to the second heater 22, may also be such that activation of the second heater 22, while the third heater 32 supplies heat to the second dryer compartment 14, does not exceed 30 A, or the outlet capacity. Stated differently, the predetermined power may be set such that a total power consumed by the second and third heaters 22, 32 is less than 30 A, in which 30 A is the outlet capacity. In at least one instance, the predetermined power may be approximately 2200 W.

Figure 3:
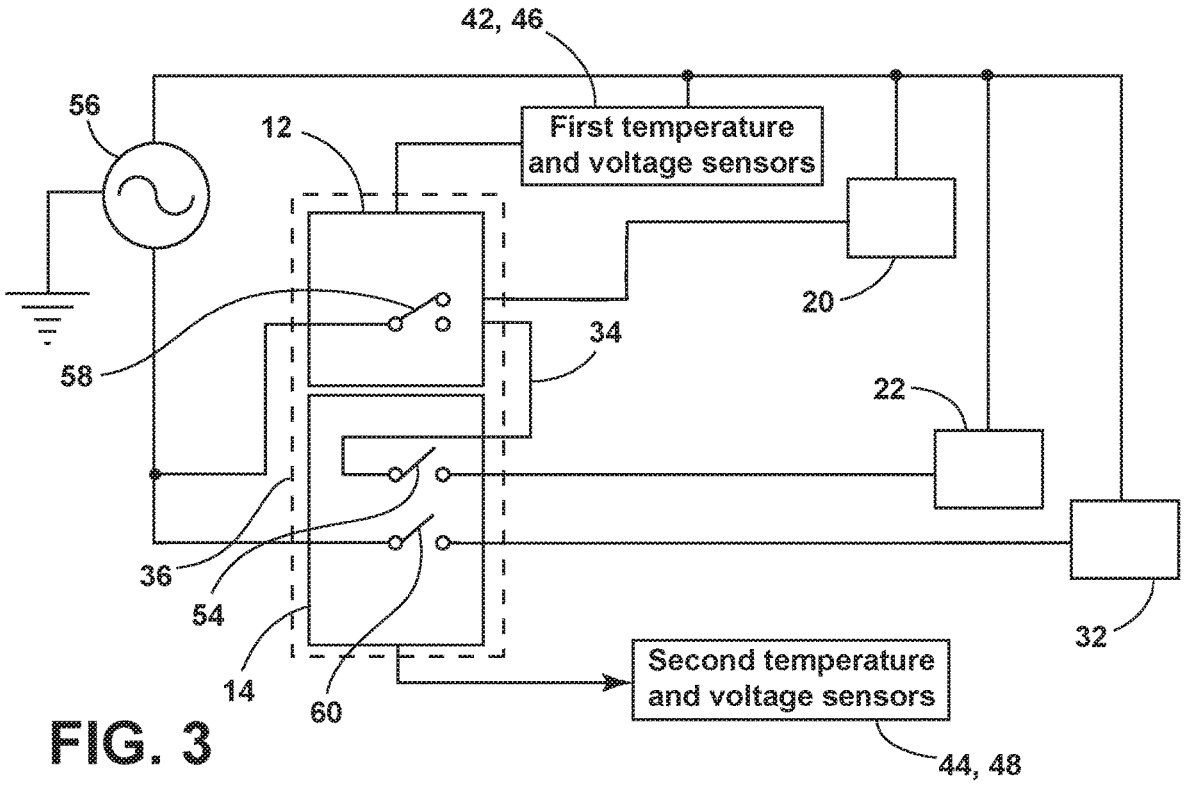
FIG. 3 is a schematic view of a relay electrically interconnecting the first and second dryer compartments.

Referring to FIG. 3, a schematic view depicting the relay 34 interconnecting the first and second dryer compartments 12, 14 to supply power to the first and second heaters 20, 22 is shown. Specifically, FIG. 3 depicts a circuit diagram showing a wiring scheme using the relay 34 to provide power between the first and second heaters 20, 22 based on demand information from the first and second voltage sensors 46, 48. As shown in FIG. 3, the first heater 20 is wired directly to the first dryer compartment 12 and the third heater 32 is wired directly to the second dryer compartment 14. The second heater 22 is interconnected to both the first and second dryer compartments 12, 14 based on activation of the relay 34, as depicted in FIG. 3. Again, operation of the first, second and third heaters 20, 22, 32 may be limited by an allowed wattage from a circuit breaker. Therefore, the first, second, and third heaters 20, 22, 32 may have a combined wattage being less than an allowed wattage used by the circuit breaker. The first, second, and third heaters 20, 22, 32 may be used in any combination, such as, but not limited to, operating the first and second heaters 20, 22, operating the first and third heaters 20, 32, and operating the second and third heaters 22, 32 such that combined operation of the first, second, and third heaters 20, 22, 32 is less than an allowed wattage by the circuit breaker. The relay 34 may be activated by a relay switch 54 to divert power between the first and second dryer compartments 12, 14, generally, and the first and second heaters 20, 22, specifically.

Additionally, a voltage source 56 is depicted as providing power to the first heater 20 and the third heater 32. As shown, the first and third heaters 20, 32 may include power switches 58, 60 used to provide power to the first and third heaters 20, 32. In at least one other instance, the first and third heaters 20, 32 may be directly wired to the voltage source 56 to provide constant power to the first and third heaters 20, 32 to provide heat to the first and second dryer compartments 12, 14, respectively. The power switches 58, 60 may be passive or active switches. In a passive system, the power switches 58, 60 may be self-regulating such that if the first and third heaters 20, 32 achieve the heating capacity for each of the first and third heaters 20, 32, the power switches 58, 60 disconnect power to the first and third heaters 20, 32 from the voltage source 56. In an active system, the power switches 58, 60 may be activated by the controller 36. For example, in an active system, the memory 50 of the controller 36 may include the target temperature and a demand threshold to activate the power switches 58, 60 based on data from the first and second voltage sensors 46, 48 and a temperature of the first heater 20 and the first dryer compartment 12. The power switches 58, 60 may be configured to directly connect the voltage source 56 to the first and third heaters 20, 32 to provide heat to the first and second dryer compartments 12, 14.

The relay switch 54 may interconnect the voltage source 56 and the first and second heaters 20, 22 using the power switch 58 for the first dryer compartment 12. For example, as described above, the power switch 58 for the first heater 20 may disconnect the voltage source 56 from the first heater 20 and connect the voltage source 56 to the relay 34 responsive to the first dryer compartment 12 reaching the target temperature, or a heating capacity of the first heater 20 and the first voltage sensor 46 indicating no demand or a demand less than the demand threshold for the first heater 20. Likewise, if the first voltage sensor 46 indicates no demand for the first heater 20 and the first dryer compartment 12 has reached the target temperature, the relay switch 54 supplies power to the second heater 22 in the second dryer compartment 14. Stated differently, the relay 34 is active in response to the first heater 20 being in an off state. The power switches 58, 60 for the first and second dryer compartments 12, 14, as well as the relay switch 54, may be a single pole, double throw switch that uses a two-way changeover switch to divert current to either the first heater 20 or the second heater 22 based on the criteria described previously. In at least one other instance, the power switches 58, 60 for the first and second dryer compartments 12, 14, as well as the relay switch 54, may be a toggle switch, a double pole, single throw switch, a contact switch, a limit switch, or any other switch that interconnects the voltage source 56 and the second heater 22 through the relay 34.

Figure 4A:
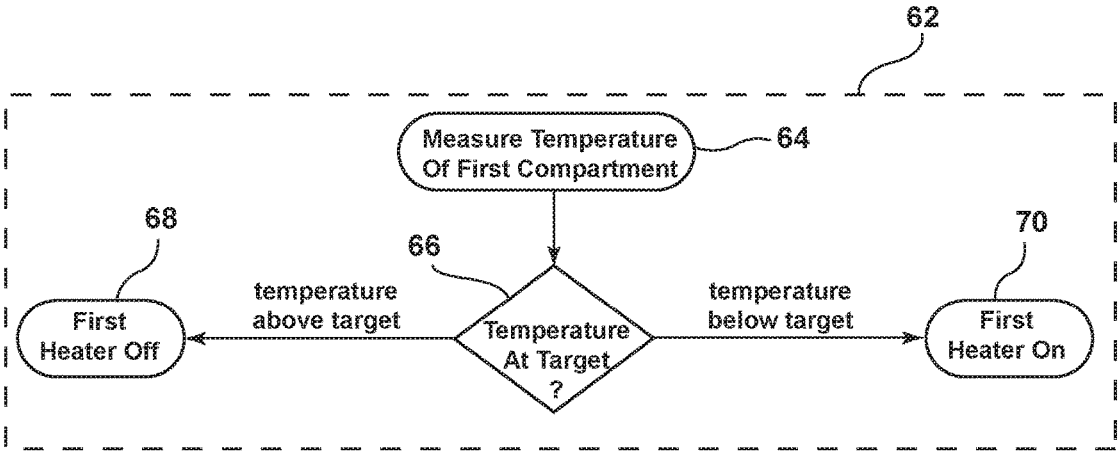
FIGS. 4A and 4B are flow diagrams depicting control logic for the appliance control system used to activate the relay for the first and second dryer compartments.
Figure 4B:
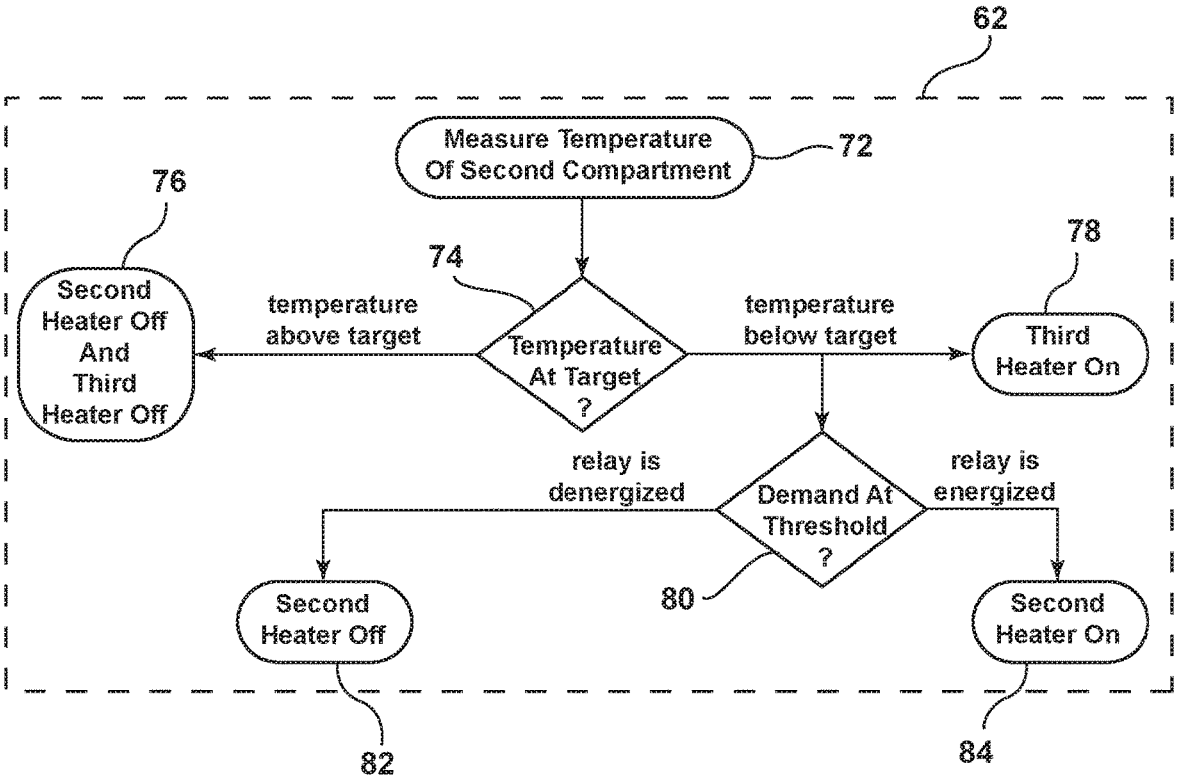

FIGS. 4A and 4B depict the control logic diagrams depicting operation of the first and second heaters 20, 22 for the first and second dryer compartments 12, 14, respectively, within the appliance control system 62. Again, the relay 34 may be a passive relay, in which the appliance control system 62 activates the relay 34 based on operating characteristics of the first and second heaters 20, 22, or the relay 34 may be an active relay, in which the appliance control system 62 activates the relay 34 with the controller 36 by comprising temperature and demand information from the first and second temperature sensors 42, 44 and the first and second voltage sensors 46, 48. Specifically, FIG. 4A depicts control logic for the appliance control system 62 showing operation of the relay 34 to supply power to the first heater 20 in the first dryer compartment 12. FIG. 4B depicts control logic for the appliance control system 62 showing operation of the relay 34 to supply power to the second heater 22 in the second dryer compartment 14. The control logic for the appliance control system 62 shown in FIGS. 4A and 4B depicts operation of the relay 34 interconnecting the voltage source 56 with the first and second heaters 20, 22.

Referring to FIG. 4A specifically, control logic for the appliance control system 62 depicting activation of the relay 34 to direct heat to the first heater 20 is shown. Again, the controller 36 may be configured to activate the relay 34 according to the temperature of the first dryer compartment 12 and a demand for heat to the first dryer compartment 12, or the relay 34 may be activated according to a heating capacity of the first heater 20. FIG. 4A depicts control logic for operation of the first heater 20 to determine activation of the relay 34. At 64, the first temperature sensor 42 detects a temperature of the first dryer compartment 12. At 66, the temperature of the first dryer compartment 12 from the first temperature sensor 42 may be indicative of a temperature in the first airflow path 24 in the first dryer compartment 12. At 64, the appliance control system 62 uses the temperature of the first dryer compartment 12 from the first temperature sensor 42 to determine if the first dryer compartment 12 has reached the target temperature.

Again, in a passive system, the target temperature may be indicative of a maximum heating capacity of the first heater 20, and, in an active system, the controller 36 may compare the temperature from the first temperature sensor 42 to the target temperature stored in the memory 50 of the controller 36. If the temperature from the first temperature sensor 42 provides data indicative of the temperature in the first airflow path 24 from the first heater 20 of the first dryer compartment 12 being greater than the target temperature, the appliance control system 62 disconnects the voltage source 56 from the first heater 20 at 68. Stated differently, at 68, the appliance control system 62 activates the relay 34 if the temperature in the first airflow path 24, which is typically indicative of a temperature of the first dryer compartment 12, is greater than the target temperature. Therefore, at 68, the appliance control system 62 deactivates or turns off the first heater 20. The appliance control system 62 turns off the first heater 20 at 68 by activating the relay 34 to disconnect the voltage source 56 from the first heater 20. As will be explained in more detail below, by activating the relay 34, the appliance control system 62 directs power from the voltage source 56 to the second heater 22.

If, at 66, the temperature from the first temperature sensor 42 provides data indicative of the temperature of the first airflow path 24 from the first heater 20 in the first dryer compartment 12 being less than the target temperature, or the heating capacity of the first heater 20 at 70, the appliance control system 62 connects the voltage source 56 to the first heater 20. At 70, the first heater 20 is activated, or turned on by the appliance control system 62 through connecting the voltage source 56 to the first heater 20 with the power switch 58 for the first heater 20, as previously discussed. Activating the first heater 20 at 70 deactivates the relay 34 such that the relay 34 is not connected to the voltage source 56, and, as such, does not provide power to the second heater 22. Therefore, responsive to a demand for heat from the first dryer compartment 12 based on a temperature of the first dryer compartment 12, the appliance control system 62 prioritizes heat to the first heater 20 for the first dryer compartment 12 at 70. Prioritizing heat to the first heater 20 allows the appliance control system 62 to efficiently and effectively manage throughput of the multi-compartment dryer 10.

Referring to FIG. 4B specifically, control logic for the appliance control system 62 to divert power, via the relay 34, to the second heater 22 is depicted. Again, the appliance control system 62 may divert power, via the relay 34, to the second heater 22 responsive to the first dryer compartment 12 reaching the target temperature, or the heating capacity of the first heater 20. Additionally, the appliance control system 62 may divert power, via the relay 34, to the second heater 22 responsive to no demand from the voltage sensors 46, 48 to the first heater 20. In at least one instance, the appliance control system 62 may divert power, via the relay 34, to the second heater 22 responsive to both the first heater 20 reaching the target temperature and the voltage sensors 46, 48 being indicative of a demand less than the demand threshold for power from the voltage source 56 to the first heater 20. In at least one other instance, the appliance control system 62 may divert power, via the relay 34, to the second heater 22 responsive to either the first dryer compartment 12 reaching the target temperature or the voltage sensors 46, 48 being indicative of a demand of the second heater 22 being greater than the demand threshold for power to the first heater 20. Stated differently, the appliance control system 62 may use information from the temperature sensors 42, 44 and the voltage sensors 46, 48, either individually or in combination, to activate the relay 34.

At 72, the second temperature sensor 44 provides a temperature of the second airflow path 26, typically being indicative of a temperature within the second dryer compartment 14. At 74, the appliance control system 62 determines if a temperature of the second airflow path 26 is at or greater than a second target temperature within the second dryer compartment 14. The temperature of the second airflow path 26 being at or greater than the second target temperature at 74 is indicative of the second dryer compartment 14 having sufficient heat from the third heater 32. As with the target temperature of the first heater 20, the second target temperature may be indicative of a heating capacity of the third heater 32, or be a preset temperature stored in the memory 50 of the controller 36. Likewise, the appliance control system 62 may be an active system, in which the controller 36 deactivates the relay 34, as well as the power switch 60, for the second heater 22 responsive to the temperature of the second dryer compartment 14 being greater than the second target temperature. The appliance control system 62 may be a passive system, in which the relay 34 and the power switch 60 for the second heater 22 are deactivated based on the third heater 32 achieving the second target temperature within the second dryer compartment 14. If, at 74, the temperature of the second dryer compartment 14 is greater than the second target temperature, the appliance control system 62 deactivates the second and third heaters 22, 32 at 76. The second and third heaters 22, 32 are deactivated at 76 because the second dryer compartment 14 being at or greater than the second target temperature is indicative of sufficient heat to the second dryer compartment 14.

At 78, responsive to the temperature of the second airflow path 26 being less than the second target temperature, the appliance control system 62 activates the third heater 32. Activating the third heater 32 at 78 is indicative of a demand for heat to the second dryer compartment 14. As described above, the third heater 32 may be responsive to any demand for heat to the second dryer compartment 14. Therefore, the third heater 32 may be directly responsive to the temperature of the second dryer compartment 14 being less than the second target temperature at 76. This allows the second dryer compartment 14 to receive heat from the third heater 32 upon demand for heat to the second dryer compartment 14. Additionally, if at 74, the temperature of the second dryer compartment 14 is less than the second target temperature, the appliance control system 62 determines, via the voltage sensors 46, 48, if the first heater 20 is active at 80. Again, the voltage sensors 46, 48 determine if the voltage source 56 is providing current to the first heater 20, which is indicative of a demand to the first heater 20 and the first dryer compartment 12 at 80.

If at 80, the appliance control system 62 determines that the first heater 20 is active using the voltage sensors 46, 48, the appliance control system 62 maintains a direct connection between the voltage source 56 and the first heater 20 to supply heat to the first dryer compartment 12 at 82. Stated differently, the appliance control system 62 maintains, at 82, a connection between the voltage source 56 and the first heater 20 using the power switch 58 associated with the first heater 20, and the relay 34 is deactivated at 82. As described above, the relay 34 being deactivated at 82 may be indicative of a demand for voltage to the first heater 20, in which the third heater 32 supplies heat to the second dryer compartment 14 and the second heater 22 is deactivated. Again, at 82, the first and third heaters 20, 32 may be actively supplying heat to the first and second dryer compartments 12, 14 while the second heater 22 is not active, or in an off state.

If, at 80, the appliance control system 62 determines that the first dryer compartment 12 has reached the target temperature such that the temperature sensors 42, 44 and the voltage sensors 46, 48 determine that no demand for heat to the first heater 20 is present, the appliance control system 62 activates the relay 34 to energize the second heater 22 at 84. At 84, the appliance control system 62 energizes the second heater 22 via the relay 34, which de-energizes the first heater 20. Stated differently, at 84, the voltage source 56 is disconnected from the first heater 20 and connected with the relay 34, such that voltage from the voltage source 56 is directed to the second heater 22 through the relay switch 54 associated with the second heater 22. Therefore, at 84, the appliance control system 62, via the relay 34 activates the second and third heaters 22, 32 to supply heat to the second dryer compartment 14. At 84, the first heater 20 may be disconnected from the voltage source 56 and deactivated. This allows the appliance control system 62 to further provide added heat to the second dryer compartment 14 using the second and third heaters 22, 32 and increase the throughput of the multi-compartment dryer 10. Again, combined use of the second and third heaters 22, 32 may not exceed the outlet capacity, as previously discussed.

According to another aspect of the present disclosure, a heater arrangement for a multi-compartment appliance comprises a first heater, a second heater and a relay. The first heater is disposed within a first airflow path for a first dryer compartment. The second heater is disposed within a second airflow path for a second dryer compartment. The relay interconnects, via an electrical harness, the first and second heaters. The relay, responsive to a demand for heat to the first heater and the first dryer compartment having a temperature being less than a target temperature, diverts power to the first heater.

The relay may also, responsive to the first heater reaching the target temperature, divert a predetermined power to the second heater. The target temperature may be indicative of a heating capacity of the first heater. The predetermined power may be an outlet capacity. The predetermined power may also be equal to 2200 watts. The heater arrangement further comprises a controller that activates the relay according to the temperature of the first heater and a demand for heat to the first dryer compartment. The heater arrangement further comprises a third heater disposed within the second airflow path, wherein the third heater is responsive to a demand for power to the second dryer compartment.

According to another aspect, a multi-compartment dryer comprises a first dryer compartment, a second dryer compartment and an appliance controller. The first dryer compartment includes a first heater and a first rotating drum disposed within the first dryer compartment. The second dryer compartment includes a second heater and a second rotating drum disposed within the second dryer compartment. The appliance controller activates a relay to divert power to the first heater based on a demand to heat the first heater and the first rotating drum being less than a target temperature.

The second dryer compartment includes a third heater that heats the second rotating drum responsive to a demand for heat to the second rotating drum. The appliance controller, responsive to the demand from the second heater and the first heater reaching the target temperature, diverts, via the relay, power to the second heater at a predetermined power. The target temperature may be set according to a first heating capacity of the first heater. The predetermined power may be less than an outlet capacity such that the third heater is active in response to the demand for heat to the second rotating drum. The predetermined power may be 2200 watts. The target temperature may also be preset and stored in a memory of the appliance controller.

According to yet another aspect, a laundry appliance system comprises an appliance controller. The appliance controller activates a relay, which, responsive to a first heater in a first dryer compartment having a temperature less than a target temperature and a demand for the first dryer compartment being greater than a demand threshold, diverts power to the first heater. The appliance controller, responsive to the first heater reaching the target temperature and the demand being less than the demand threshold, diverts power to a second heater in a second dryer compartment.

The appliance controller activates a third heater to heat the second dryer compartment responsive to a demand for heat to the second dryer compartment. The relay diverts a predetermined power to the second heater such that a total power of the second and third heaters is below an outlet capacity. The predetermined power may be equal to 2200 watts. The target temperature may be indicative of a maximum heating capacity of the first heater. The target temperature may also be preset and stored in a memory of the appliance controller.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A heater arrangement for a multi-compartment appliance comprising:

a first heater disposed within a first airflow path for a first dryer compartment;

a second heater disposed within a second airflow path for a second dryer compartment; and a relay that interconnects, via an electrical harness, the first and second heaters, the relay, responsive to a demand for heat to the first heater and the first dryer compartment having a temperature being less than a target temperature, diverts power to the first heater.

2. The heater arrangement of claim 1, wherein the relay, responsive to the first dryer compartment reaching the target temperature, diverts a predetermined power to the second heater.

3. The heater arrangement of claim 2, wherein the target temperature is indicative of a heating capacity of the first heater.

4. The heater arrangement of claim 2, wherein the predetermined power is an outlet capacity.

5. The heater arrangement of claim 4, wherein the outlet capacity is equal to 30 amps.

6. The heater arrangement of claim 1 further comprising a controller that activates the relay according to the temperature of the first dryer compartment and a demand for heat to the first heater.

7. The heater arrangement of claim 1 further comprising a third heater disposed within the second airflow path, wherein the third heater is responsive to a demand for power to the second dryer compartment.

8. A multi-compartment dryer comprising:

a first dryer compartment including a first heater and a first rotating drum disposed within the first dryer compartment;

a second dryer compartment including a second heater and a second rotating drum disposed within the second dryer compartment; and an appliance controller that activates a relay to divert power to the first heater based on a demand to heat the first heater and the first rotating drum being less than a target temperature.

9. The multi-compartment dryer of claim 8, wherein the second dryer compartment includes a third heater that heats the second rotating drum responsive to a demand for heat to the second rotating drum.

10. The multi-compartment dryer of claim 9, wherein the appliance controller, responsive to the demand from the second heater and the first rotating drum reaching the target temperature, diverts, via the relay, power to the second heater at a predetermined power.

11. The multi-compartment dryer of claim 10, wherein the target temperature is set according to a first heating capacity of the first heater.

12. The multi-compartment dryer of claim 10, wherein the predetermined power is less than an outlet capacity such that the third heater is active in response to the demand for heat to the second rotating drum.

13. The multi-compartment dryer of claim 12, wherein the outlet capacity is less than 30 amps.

14. The multi-compartment dryer of claim 8, wherein the target temperature is preset and stored in a memory of the appliance controller.

15. A laundry appliance system comprising:

an appliance controller that activates a relay, which, responsive to a first heater in a first dryer compartment having a temperature less than a target temperature and a demand for the first dryer compartment being greater than a demand threshold, diverts power to the first heater, and which, responsive to the first dryer compartment reaching the target temperature and the demand being less than the demand threshold, diverts power to a second heater in a second dryer compartment.

16. The laundry appliance system of claim 15, wherein the appliance controller activates a third heater to heat the second dryer compartment responsive to a demand for heat to the second dryer compartment.

17. The laundry appliance system of claim 16, wherein the relay diverts a predetermined power to the second heater such that a total power of the second and third heaters is below an outlet capacity.

18. The laundry appliance system of claim 17, wherein the outlet capacity is equal to 30 amps.

19. The laundry appliance system of claim 15, wherein the target temperature is indicative of a maximum heating capacity of the first heater.

20. The laundry appliance system of claim 15, wherein the target temperature is preset and stored in a memory of the appliance controller.

* * * * *